United States Patent [19]

Heymanns

[11] Patent Number: 4,877,196

[45] Date of Patent: Oct. 31, 1989

[54] RIDER ROLLER FOR A ROLL FORMED IN A WEB-WINDING MACHINE

[75] Inventor: Willi Heymanns, Kaarst, Fed. Rep. of Germany

[73] Assignee: Jagenberg Aktiengesellschaft, Dusseldorf, Fed. Rep. of Germany

[21] Appl. No.: 206,010

[22] Filed: Jun. 10, 1988

[30] Foreign Application Priority Data

Jun. 10, 1987 [DE] Fed. Rep. of Germany ..... 3719282

[51] Int. Cl.[4] ..... B65H 18/20

[52] U.S. Cl. ..... 242/66

[58] Field of Search ..... 242/66, 65, 67.1 R, 242/75.1, 75.2

[56] References Cited

U.S. PATENT DOCUMENTS

| | | | |
|---|---|---|---|
| 1,117,114 | 11/1914 | Wagg | 242/65 |
| 1,355,107 | 10/1920 | Johnstone | 242/66 |
| 1,793,559 | 2/1931 | Reedy | 242/65 |
| 2,204,934 | 6/1940 | Johnsen | 242/66 X |
| 2,980,356 | 4/1961 | Beese et al. | 242/66 X |
| 3,186,443 | 6/1965 | Budzyna | 242/75.2 X |
| 3,240,442 | 3/1966 | Kilmartin | 242/66 |
| 3,606,186 | 9/1971 | Cohn et al. | 242/66 X |

FOREIGN PATENT DOCUMENTS

| | | |
|---|---|---|
| 2739515 | 4/1981 | Fed. Rep. of Germany . |
| 3102894 | 1/1983 | Fed. Rep. of Germany . |

*Primary Examiner*—John M. Jillions

*Attorney, Agent, or Firm*—Herbert Dubno

[57] ABSTRACT

A rider roller for use in a web-winding machine for processing a web material has grooves arranged in its surface so as to facilitate the transport of entrained air, thus avoiding puckers and wrinkles in the roll of web material which is being wound.

16 Claims, 3 Drawing Sheets

RIDER ROLLER FOR A ROLL FORMED IN A WEB-WINDING MACHINE

FIELD OF THE INVENTION

My present invention relates to a rider roll for use in a web-winding machine for processing web materials, such as paper, e.g. by winding the same in rolls.

BACKGROUND OF THE INVENTION

In order to produce good quality rolls of web materials by winding (rolling up) a web and to avoid technical difficulties in further process steps (such as might be encountered by dividing the roll transversely into two segments), it is important to have a uniform winding hardness over the entire processing range of the material. Uniform hardness also tends to suppress the potential for damage, such as tears, in the web material. To achieve the desired hardness, a known method is to provide rider rolls which press against the outer circumference of the rewinding roll as the roll increases in diameter, so as to provide a constant hardness-controlling linear pressure.

In an apparatus disclosed in German Pat. No. 27 39 515 for winding, for example, a web of paper onto a core which is supported on two driven winder drums, the rewinding roll lies in a crevice (constrained space) between both of the winder drums and is pushed against by a rider roll which supplies the linear pressure to effect the desired winding hardness.

A web-winding machine is disclosed in German Pat. No. 3 102 894 for the separate winding up of lengthwise-divided web material, which has only one center drum, on which lie two rewinding rolls one on each side of a vertical plane through the axis of the center drum. In order to produce the linear pressure needed to control the winding hardness, hydraulically or pneumatically-activated cylinder drives are provided which compensate for the increasing bulk of the rewinding roll; moreover, arranged around the periphery of the rewinding roll, rider roll pairs are provided, these roll pairs being positioned in the web-winding machine at both sides of the center drum by means of swivelable levers on positioning members which can be raised or lowered.

At each winding station, the pressure exerted by means of the rider roll is maintained at least up to the point where a predetermined roll diameter is achieved, so that enough inherent firmness is achieved so as to be adequate for any further processing steps, and so that an evenly distributed winding hardness is achieved over the entire width of the rewinding roll. The pressure applied by means of each rider roll is exerted at the resting place of the common tangent of the rewinding roll, however it has been found that, disadvantageously, a pucker or air pocket can form in the web material in front of the rider roll as viewed in the direction of winding. Upon passage of such an air pocket through the roller crevice, creases are produced which reduce the quality of the wound material and result in misalignment of the wound layers. The origin of these air pockets is the entrainment of air in the crevice between the web of material and the wound roll.

OBJECTS OF THE INVENTION

It is an object of my present invention to provide a rider roll which enables avoidance of air pockets or creases in a web of material being wound, and enables avoidance of misalignment of the wound layers.

Another object is to provide an improved roll-winding machine which obviates the prior art drawbacks.

Yet another object is to provide an improved method of winding a roll to achieve more uniform hardness.

SUMMARY OF THE INVENTION

These and other objects are achieved in accordance with the present invention by providing a rider roll having grooves in its web-contacting surfaces, these grooves serving to facilitate the passage of the air entrained between the upper surface of the web of material (paper, for instance) and the winding roll, through the crevice between the rider roll and the rewinding roll, thus obviating the aforementioned deleterious effects of this entrained air.

In this way, the formation of puckers (air pockets in the roll) or wrinkles is avoided. The grooves may be transverse grooves or, preferably, are formed in a screwlike or helical configuration, advantageously extending over the total breadth of the rider roll.

The grooves are advantageously from 2 to 25 mm wide, most advantageously 15 mm wide, of a length at least equal to the axial length of the rider roll, and from 0.1 to 3 mm deep, most advantageously 0.6 mm deep. It has been found that with grooves of these dimensions, a paper web can fit into them such that the transported air can be transported through the roller crevice without adverse side effects.

In the cases where the roll cover of the rider roll is provided with grooves arranged in a screwlike configuration, the angle of inclination of these grooves with respect to the horizontal, a generatrix or the axis of the rider roll, must be smaller than 75° Advantageously, this angle is between 2 and 45°, most preferably between 5 and 30°.

In this angle range, there is sufficient air penetration through the roller crevice between the rider roll and the rewinding roll, without having the grooves produce a disturbing noise generation when the web-winding machine is operated.

The rider roll may comprise a core and a cover, the latter being formed with the grooves, thereby enabling the use of metal for the core and a more elastic material for the cover or surface.

In the case of a rider roll whose covering surface is advantageously grooved elastic surface, especially a grooved rubber surface, the specific surface pressure and thus the pressure on the rewinding roll at constant linear pressure between the rewinding roll and the rider roll may be reduced, since the rubber cover deforms under pressure and a larger moving surface is present between the rider roll and the rewinding roll.

BRIEF DESCRIPTION OF THE DRAWINGS

The above and other objects, features and advantages of the present invention will become more readily apparent from the following description, reference being made to the accompanying diagrammatic drawing in which.

SPECIFIC DESCRIPTION

Figure 2:
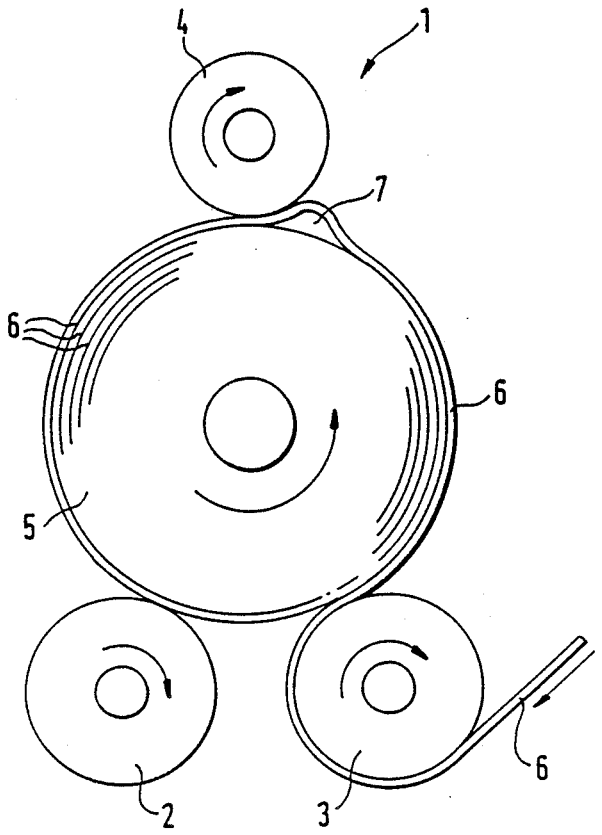
FIG. 2 is a similar view of a roller assemblage with a winding roll supported by two winder drums and pressed from above by a rider roll.
Figure 3:
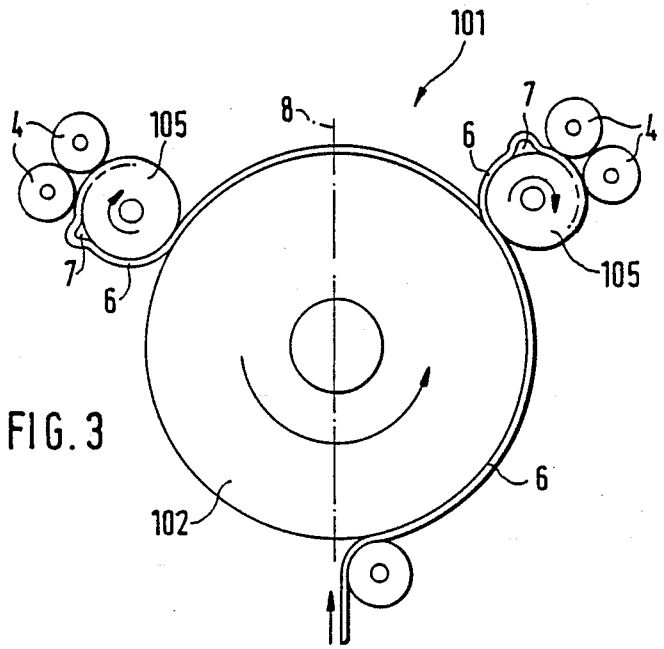
FIG. 3 is a similar view of another roller assemblage having two rewinding rolls at some distance from one another supported on the upper circumferential surface of a center drum while at the same time being pressed on by pairs of rider rolls.
Figure 4:
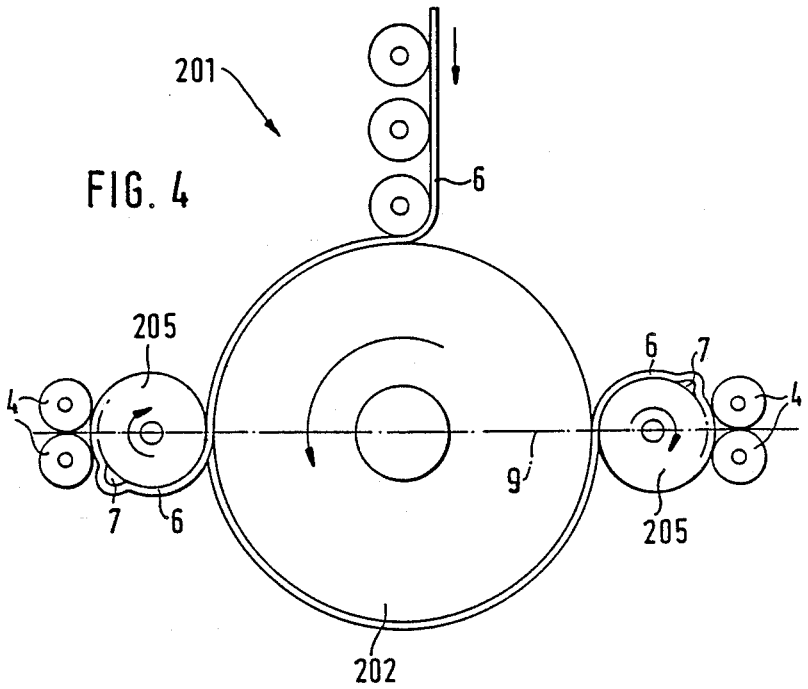
FIG. 4 is a similar view of an assemblage in accordance with FIG. 3 having, in the median horizontal plane of the center drum and situated on both sides of the center drum rewinding rolls which are pressed on by pairs of rider rolls.

In FIGS. 2–4, differing variations of the roller assembly 1 of a web-winding machine are depicted.

The embodiment in accordance with FIG. 2 comprises three winder drums 2 and 3 which turn in the direction of the arrows, and at a distance above them, centrally positioned, a rider roll 4.

In the crevice region between the winder drums 2 and 3 and the rider roll 4 there is an essentially larger-diameter rewinding roll 5. The diameter of the rewinding roll increases as it becomes wound with the length of the web 6 of material which may have been unrolled from a feed roller (not depicted) before being wound up again.

The rewinding roll 5 is put into motion by frictional coupling with the driven winding drums 2 and 3.

The rider roll 4 applies the longitudinal pressure required between the winding drums 3 and the rewinding roll 5 to bring about uniformly firm winding action by the rewinding roll 5. In this way, there is produced an air pocket 7, as shown in an exaggerated way in FIG. 2, the rewinding roll 5 in the region between the rider roll 4 and between the top layer position of the web 6 of material and the rewinding roll 5, and immediately in front of the rider roll 4 in the sense of the direction of rotation of the rewinding roll 5.

In the winding assemblages 101 and 201 shown in FIGS. 3 and 4 each of the driven center drums 102 and 202 supports two rewinding rolls 105 and 205 respectively, which are shown as still very small, and onto which successively the web material 6 is wound, being fed lengthwise from the bottom in accordance with FIG. 3 and from the top in accordance with FIG. 4, until the desired finished diameter of the wound rolls is reached.

In the embodiment in accordance with FIG. 3, the rewinding rolls 105 are positioned alternately at one or the other side of the vertical plane 8 running through the axis of the center drum 102 and on the upper circumferential surface of the center drum 102. In the embodiment in accordance with FIG. 4, the rewinding rolls 205 are on either side of the horizontal plane 9 running through the axis of the center drum 202. In both cases, the rewinding roll 105 or 205 respectively are loaded by (pressed upon by) rider roll pairs each consisting of two rider rolls 4.

Also in this case, there is an air pocket 7 formed between the outermost position of the material web 6 and the rewinding rolls 105 and 205 respectively, just before the forwardmost rider roll 4, viewed in the direction of rotation of 105 and 205 as indicated by the arrows.

Figure 1:
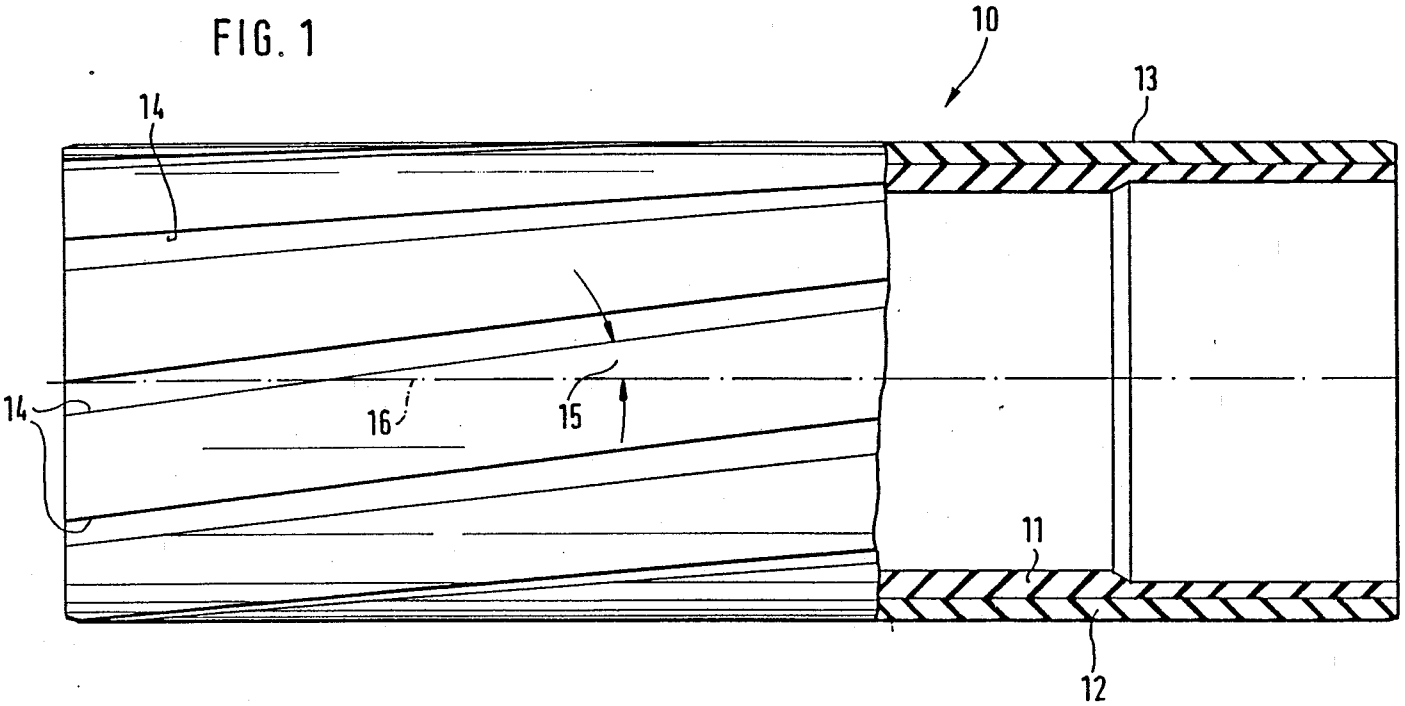
FIG. 1 is an elevational view of a rider roll, partially in longitudinal section, with diagonal grooves in an elastic covering.

The formation of this sort of pocket (pucker or wrinkle) 7 in the direction of rotation of rewinding rolls 5, 105 and 205 may be hindered in accordance with the invention by the rider roll 10 as depicted in FIG. 1.

The roll 10 comprises a roll core 11 and a roll covering 12 made of rubber. The surface 13 of the roll core 12 is provided with a multiplicity of parallel grooves 14 which extend over the entire breadth of the roll at some distance from one another; these run in a screw thread like manner with an angle 15 of 15 degrees with respect to the linear axis 16 of the roller 10 and extend over the entire breadth of the roll. The entrained air between the uppermost position 6 of the material web and the winding rolls 5, 105 and 205 is transported by way of the crevice or crevice between the rider roll 10 and the rewinding rolls 5, 105 and 205. The air thus distributes itself smoothly, without causing adverse effects such as producing wrinkles or the like.

The elastic surface 13 of the rider rolls produces an attenuated localized pressure on the surface between the rider rolls 10 and the rewinding rolls 5, 105, and 205. The linear pressure between the carrier drums 2, 3, 102 and 202 and the rewinding rolls 5, 105 and 205 can be elevated by relatively greater pressure of the rider roller 10.

I claim:

1. A web-winding machine comprising:

at least one support roller;

a roll of a web resting upon said support roller and adapted to be wound up by rotation by contact with said support roller;

means for feeding said web to said support roller for winding in said roll; and at least one rider roller resting against said roll and contacting said web only after said web has been wound on said roll and wherein said rider roller is nonsupporting of said roll and is located across said roll from a region at which said web first meets the roll said rider roller having a web-engaging surface formed with a multiplicity of grooves.

2. The web-winding machine defined in claim 1 wherein said grooves are arranged in a helical configuration.

3. The web-winding machine defined in claim 2 wherein said grooves are arranged at an angle of less than 75° with respect to the axis of said rider roller.

4. The web-winding machine defined in claim 2 wherein said grooves are arranged at an angle of from 2° to 45° with respect to the axis of said rider roller.

5. The web-winding machine defined in claim 2 wherein said grooves are arranged at an angle of from 5° to 30° with respect to the axis of said rider roller.

6. The web-winding machine defined in claim 1 wherein said grooves extend over the entire length of said rider roller.

7. The web-winding machine defined in claim 1 wherein said grooves are from 2 to 25 mm in width and from 0.1 to 3 mm in depth.

8. The web-winding machine defined in claim 1 wherein said rider roller comprises a roller core and a roller cover provided with said grooves and composed of elastic material.

9. The web-winding machine defined in claim 8 wherein said roller cover is comprised of rubber.

10. A method of rolling a web into rolls wherein said web is fed to a roll being wound on at least one support roller and a nonroll-supporting rider roller rests against said roll at a location spaced from a location at which said web meets said roll and said rider roller contacts said web only after said web has been wound on said roll, which comprises the step of maintaining the firmness of said roll by permitting the escape of air trapped by said web by contacting said web with a multiplicity of grooves formed in a web-contacting-surface of said rider roller at a location across the roll from the location at which said web first meets the roll.

11. The method defined in claim 10 wherein said grooves are arranged in a helical configuration.

12. The method defined in claim 11 wherein said grooves are arranged at an angle of less than 75° with respect to the axis of said rider roller.

13. The method defined in claim 12 wherein said grooves are arranged at an angle of from 2° to 45° with respect to the axis of said rider roller.

14. The method defined in claim 13 wherein said grooves are arranged at an angle of from 5° to 30° with respect to the axis of said rider roller.

15. The method defined in claim 14 wherein said grooves extend over the entire length of said rider roller.

16. The method defined in claim 15 wherein said grooves are from 2 to 25 mm in width and from 0.1 to 3 mm in depth.

* * * * *